US005490047A

United States Patent [19]

O'Rourke et al.

[11] Patent Number: 5,490,047

[45] Date of Patent: Feb. 6, 1996

[54] ILLUMINATED BALL

[76] Inventors: Thomas J. O'Rourke, 1006 Rodney Dr., Nashville, Tenn. 37205; Bruce D. Lund, 4442 N. Seely Ave., Chicago, Ill. 60618

[21] Appl. No.: 275,015

[22] Filed: Jul. 13, 1994

[51] Int. Cl.[6] ..... A63B 43/06

[52] U.S. Cl. ..... 362/234; 362/235; 362/361; 273/586; 273/DIG. 8; 273/65 EF; 446/439

[58] Field of Search ..... 362/253, 235, 362/190, 390, 352, 353, 374, 806, 234, 361; 273/65 EF, DIG. 24, 58 G, DIG. 8, 55 B; 446/485, 409, 484, 438, 439

[56] References Cited

U.S. PATENT DOCUMENTS

| | | | |
|---|---|---|---|
| 3,580,575 | 5/1971 | Speeth | 273/58 G |
| 5,054,778 | 10/1991 | Maleyko | 273/DIG. 8 X |
| 5,066,011 | 11/1991 | Dykstra et al. | 273/65 EF X |
| 5,066,012 | 11/1991 | Stark | 362/253 X |
| 5,102,131 | 4/1992 | Remington et al. | 273/58 G |
| 5,186,458 | 2/1993 | Redoudo | 273/65 EF |
| 5,236,383 | 8/1993 | Connelly | 446/485 X |
| 5,316,293 | 5/1994 | Hamilton | 273/65 EF |

*Primary Examiner*—Ira S. Lazarus
*Assistant Examiner*—Thomas M. Sember
*Attorney, Agent, or Firm*—Waddey & Patterson; Edward D. Lanquist, Jr.

[57] ABSTRACT

The present invention discloses an illuminated ball. The illuminated ball has a translucent core which is, in the preferred embodiment, made of polyurethane which is translucent. Integrally molded with the shell is a component tree or light source having branches extending from the center. At the tip of each of these branches is placed a high density LED light. A plug is provided on an lower side of the ball to allow access to the light assembly and to allow the battery to be changed. On an upper side of the ball there is placed a power switch which allows the light to be turned on and off.

11 Claims, 4 Drawing Sheets

ILLUMINATED BALL

BACKGROUND OF THE INVENTION

The present invention relates generally to sporting goods and toy products, and more particularly to a ball such as a football, round ball, or any other game ball or play ball which is internally lighted.

It will be appreciated by those skilled in these respective arts that balls and toys stimulating ball play are very popular. However, many of the consumers of balls and toy products simulating balls may desire to use said products in a darkened environment. Previous to the said invention, "Illuminated Ball", a standard ball or like toy ball would be difficult to see and could easily be lost in such an environment.

The need, then, is for a ball which can be internally lighted. This needed ball must be manufacturable. Furthermore, this lighted ball must be light enough in weight for effective throwing, sufficiently soft to be safely caught, and durable enough to survive intact the expected usage of a ball. Such a needed ball is presently lacking in these prior arts.

SUMMARY OF THE INVENTION

The present invention discloses an illuminated ball. The illuminated ball has a translucent core which is, in the preferred embodiment, made of polyurethane foam which is translucent. Integrally molded with the shell is a component tree or light source. At the tip of each of these branches is placed an LED. A plug is provided on a lower side of the ball to allow access to the battery receptacle and to allow the battery to be changed. On an upper side of the ball there is placed a power switch which allows the light to be turned on and off.

Accordingly, one object of the present invention is to provide a ball which can be illuminated.

Still another object of the present invention is to provide a ball which is light in weight and can be thrown.

Still a further object of the present invention is to provide a ball which can be efficiently and inexpensively manufactured.

DESCRIPTION OF THE PREFERRED EMBODIMENT

Figure 1:
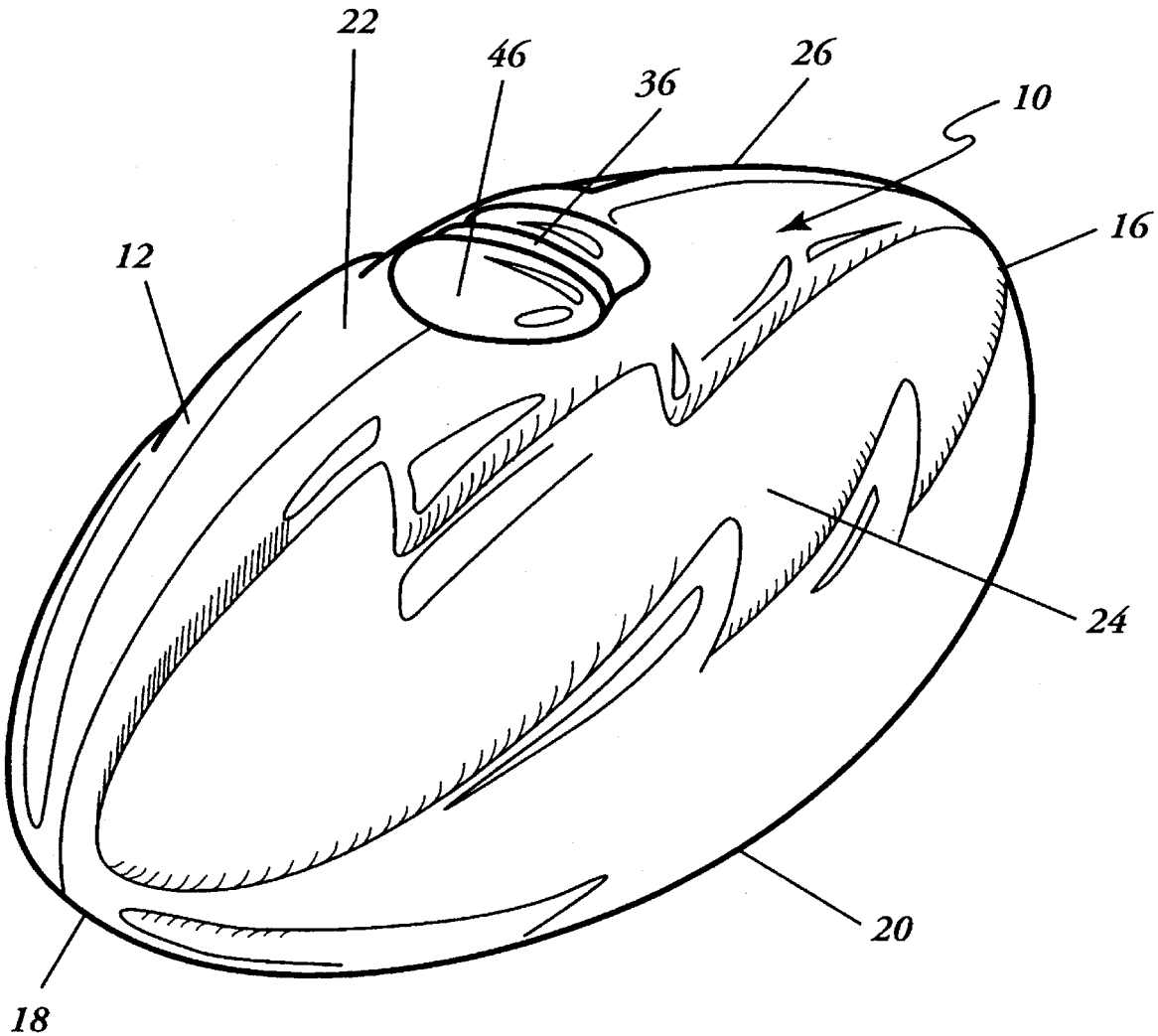
FIG. 1 is a perspective view showing the lower side of the ball.

Referring now to FIG. 1 there is shown generally at 10 the illuminated ball of the present invention. Ball 10 has nose 16, tail 18, upper side 20, underside 22, first side 24, and second side 26. Around the surface of ball 10 there is placed shell or coating 12. Attached to ball 10 proximate to lower side of ball there is placed plug 46 held in place by elastic band 36 which is, in the preferred embodiment, an elastomeric surgical band.

Figure 2:
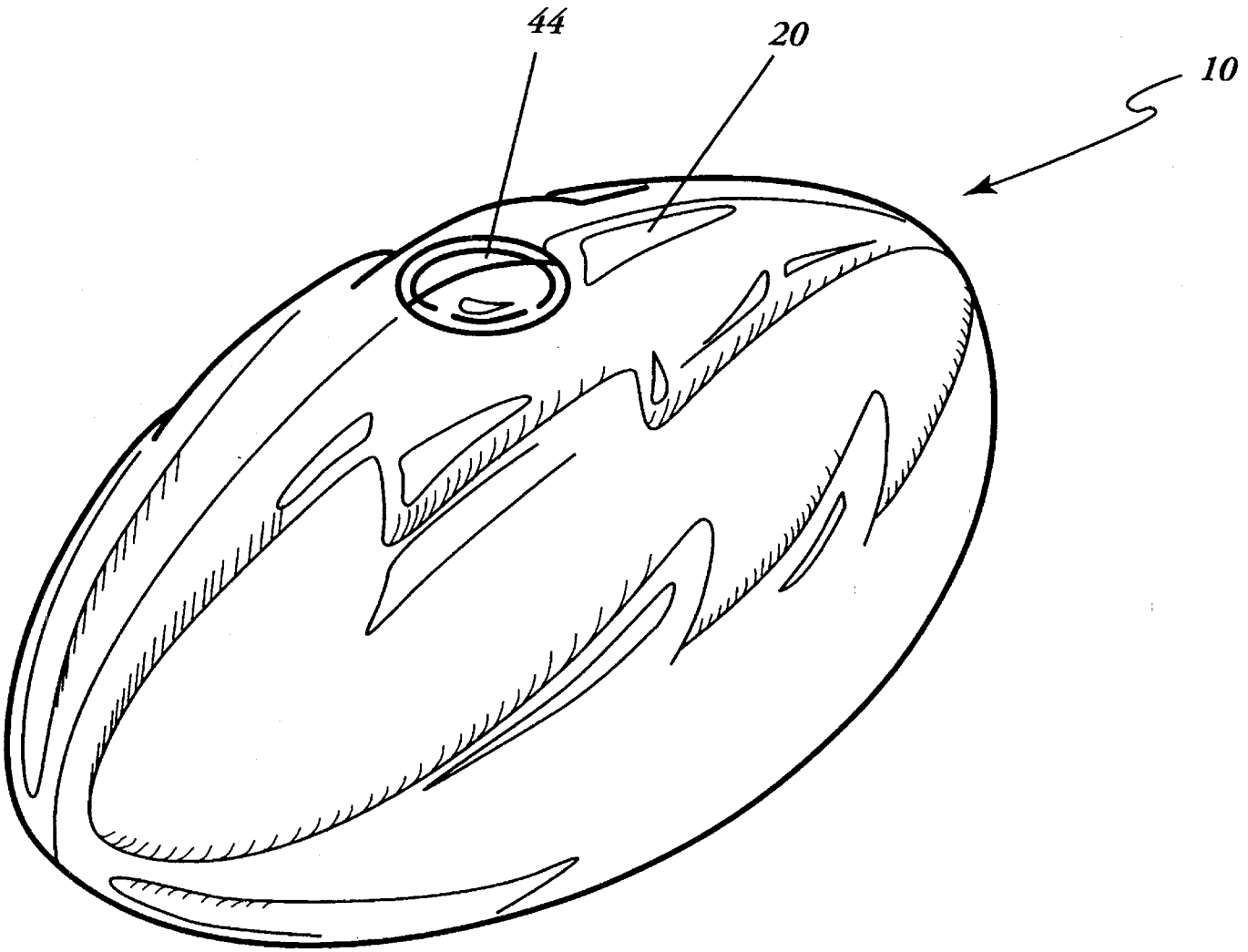
FIG. 2 is a perspective view showing the upper side of the ball.

Referring now to FIG. 2 there is shown generally at 10 the illuminated ball of the present invention. In this view, power switch 44 is attached to ball 10 proximate to upper side 20 of ball. This switch is a pressure sensitive switch which allows the light described in FIG. 3 below to be turned on and off.

Figure 3:
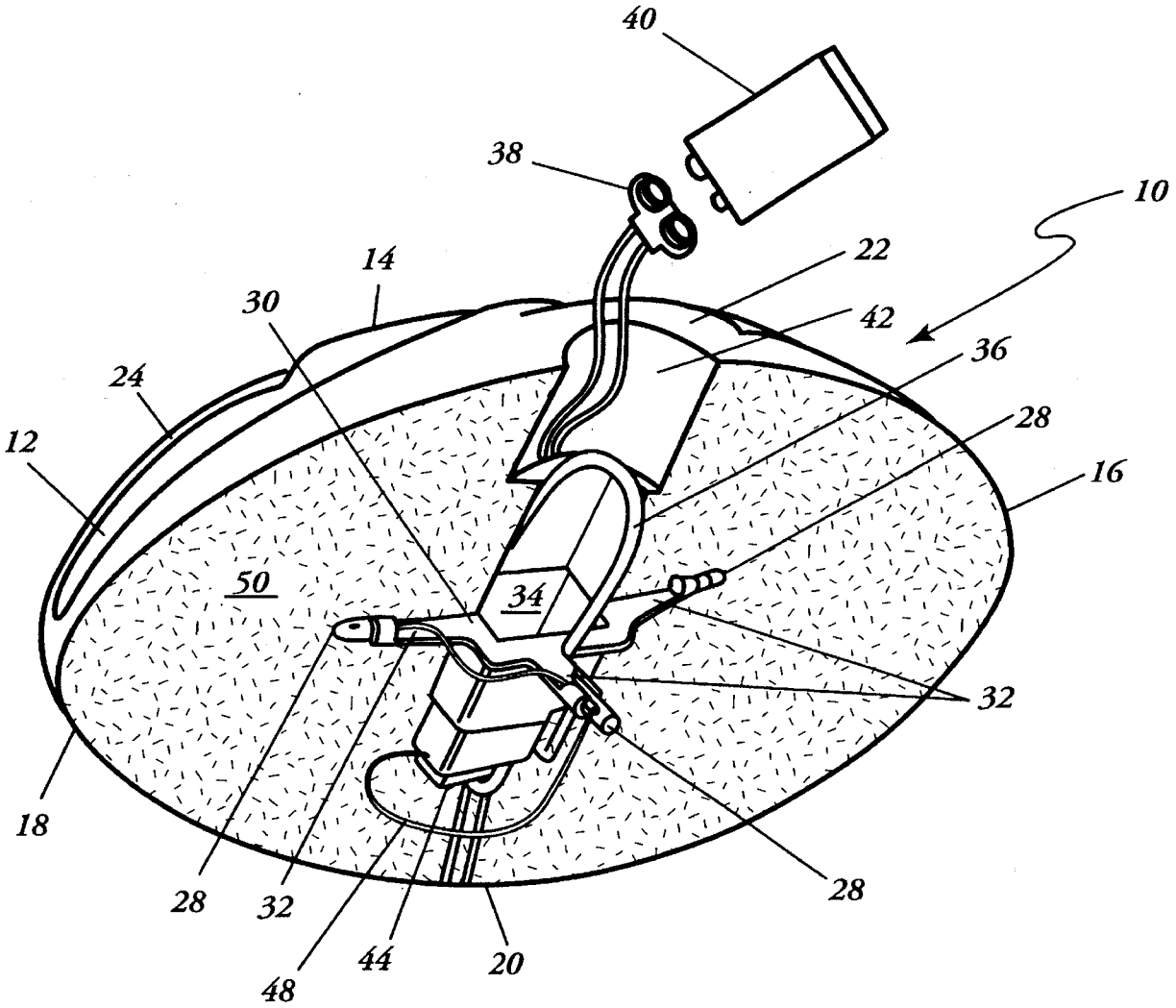
FIG. 3 is a perspective cut-away view showing the light source of the ball of the present invention.

Referring now to FIG. 3 there is shown generally at 10 still another view of the ball of the present invention. As can be seen, ball 10 has shell or coating 12 surrounding translucent core 50. In the preferred embodiment, translucent core 50 is made from polyurethane foam. In the preferred embodiment, light source or light component tree 30 is integrally molded into core 50. Tree 30 has battery holder 34. Attached to battery holder 34 there are branches 32 extending outwardly. At the tip of each branch 30 there is placed high density LED light 28. However, any high intensity light source can be used. As can be seen from FIG. 3, elastic band 36 which holds plug 46 in place as shown in FIG. 1, surrounds light source or tree 30. As can be seen in FIG. 3, wire 48 connects light source 28 to power switch 44. Also attached to tree 30 there is placed battery leads 38 which receive battery 40 which is, in the preferred embodiment, a standard 9-volt battery. Thus, battery 40 is received by battery holder 34. After battery 40 is put in place, plug 46 is put in place and elastic band 36 holds it in place.

Figure 4:
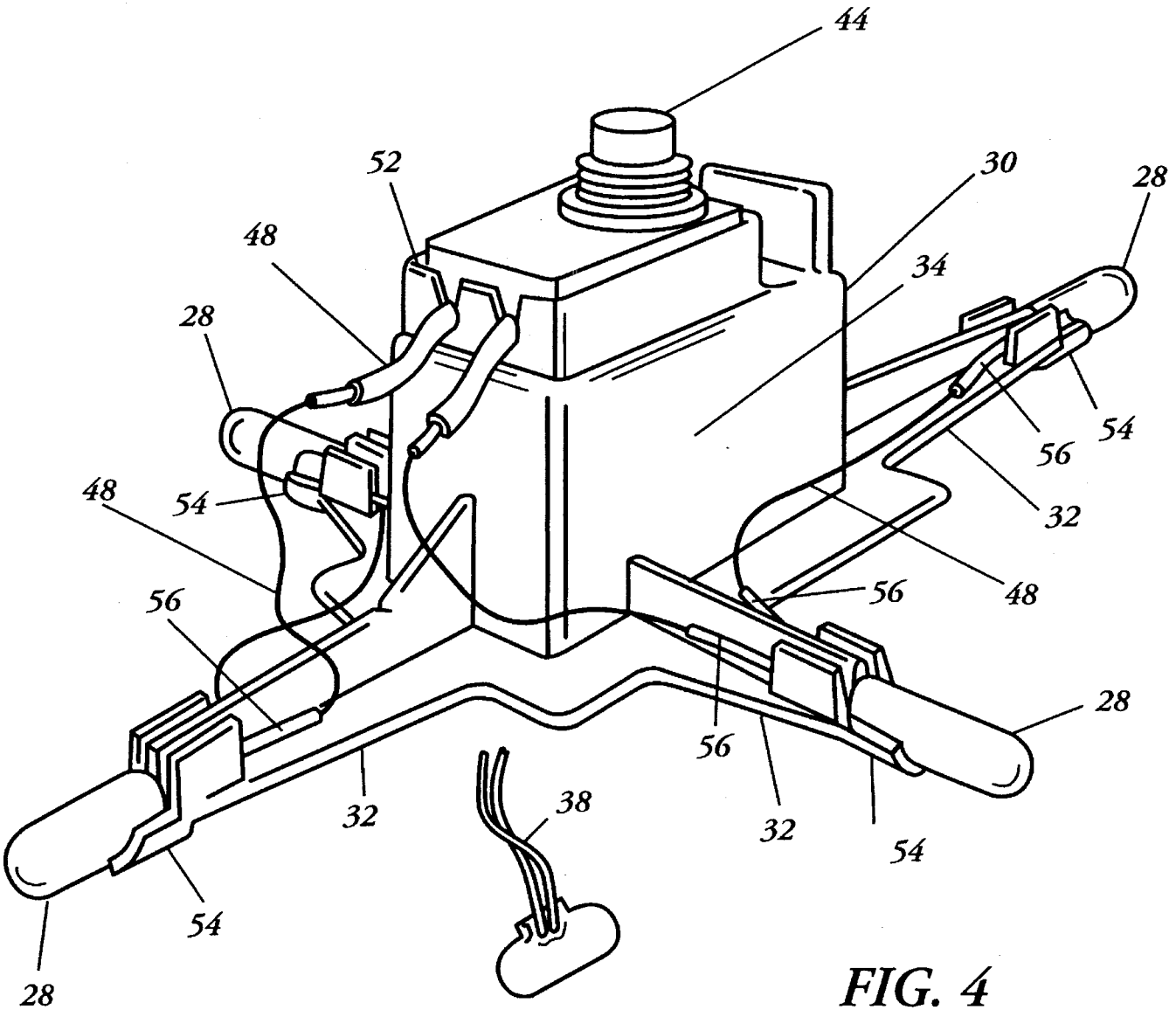
FIG. 4 is a perspective view of the light assembly component or light source of the present invention.

Referring now to FIG. 4 there is shown generally at 30 the light assembly or light source of the present invention. Extending from tree 30 there are plural branches 32. At the tip of branched 32 there are placed lights 28. Tree 30 is all attached as one piece in the preferred embodiment and includes switch 44, wires 48, leads 38, and holder 34. Tree 30 is molded with recess 52 for switch 44 and an opposite hole which acts as battery holder 34. Lights 28 fit into light holders 54 which also receive light wires 56.

In the preferred embodiment, shell or coating 12 is latex paint. Also in the preferred embodiment, ball 10 has lightning bolt pattern 14.

Although the drawings may show a ball in the shape of a football or rugby ball, the invention is not intended to be limited to any one shape. In fact, a round ball or square ball or ball of any shape can be illuminated in this manner.

Thus, although there have been described particular embodiments of the present invention of a new and useful illuminated ball, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An illuminated ball comprising:

a. a translucent core;

b. a light assembly integrally molded within said translucent core c. said translucent core having a nose, a tail, an upper side, a lower side, and an opening proximate said lower side for receiving a power source for said light source;

d. a plug received by said opening; and e. an elastic band to hold said plug in said opening.

2. The illuminated ball of claim 1 further comprising means electrically attached to said light assembly to turn said light assembly on and off.

3. The illuminated ball of claim 1 further comprising:

a. said illuminated core having a nose, a tail, an upper side and a lower side; and b. a power switch placed within said translucent core proximate said upper side.

4. The illuminated ball of claim 1 wherein said translucent core being coated.

5. The illuminated ball of claim 1 wherein said light source comprises high intensity LED lights.

6. The illuminated ball of claim 5 wherein said light assembly further comprises a component tree having plural branches attached to said high intensity LED lights.

7. The illuminated bah of claim 1 wherein said translucent core comprises polyurethane foam.

8. The illuminated ball of claim 1 wherein said translucent core being coated with latex paint.

9. A ball comprising:

a. an electronic light tree having branches extending outwardly and high density LED lights attached to said branches;

b. a translucent core surrounding said electronic light tree, wherein said electronic light tree is integrally molded into said translucent core and having an opening;

c. a power switch connected to said electronic light tree by wires and attached to said translucent core;

a power source retained in said opening by an elastic band.

10. The ball of claim 9 further comprising a coating attached to said translucent core.

11. An illuminated ball having a nose, a tail, an upper side, a lower side, a first side and a second side comprising:

a. a core made from polyurethane foam;

b. a component tree having plural branches attached to plural high intensity LED lights;

c. a power switch integrally molded into said translucent core proximate said upper side;

d. a latex coating attached to said translucent core;

e. said translucent core having an opening proximate said lower side;

f. a battery holder attached to said component tree;

g. a battery received by said battery holder;

h. a plug received by said opening; and i. an elastic band to hold said plug in said opening.

* * * * *